US006508628B2

(12) United States Patent
Amr

(10) Patent No.: US 6,508,628 B2
(45) Date of Patent: Jan. 21, 2003

(54) METHOD OF ASSEMBLING A HIGH SOLIDITY AXIAL FAN

(75) Inventor: Yehia Mahmoud Amr, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/789,205

(22) Filed: Feb. 20, 2001

(65) Prior Publication Data

US 2002/0114699 A1 Aug. 22, 2002

(51) Int. Cl.[7] ..... F04D 29/32
(52) U.S. Cl. ..... 416/189; 416/145; 416/241 A
(58) Field of Search ..... 416/195, 196 R, 416/196 A, 199, 241 A, 248

(56) References Cited

U.S. PATENT DOCUMENTS 3,679 A * 7/1844 Catterton ..... 416/196 R
56,834 A * 7/1866 Todd ..... 416/196 R
247,654 A * 9/1881 Jones ..... 416/241 A
809,277 A * 1/1906 Barker ..... 416/196 R
3,749,519 A * 7/1973 Ryba ..... 416/241 A
5,076,760 A * 12/1991 Weetman et al. ..... 416/241 A
5,611,668 A * 3/1997 Yapp et al. ..... 416/189
6,033,183 A * 3/2000 Genster ..... 416/241 A

* cited by examiner

*Primary Examiner*—Edward K. Look
*Assistant Examiner*—Igor Kershteyn
(74) *Attorney, Agent, or Firm*—Carlson, Gaskey & Olds

(57) ABSTRACT

The subject invention is a method of fabricating a high solidity axial fan assembly to improve fan stall properties to allow the fan assembly to run at slower speeds. The method includes the steps of providing a first plurality of fan blades attached to a first hub, providing a second plurality of fan blades attached to a second hub, interfitting said second plurality of fan blades between said first plurality of fan blades; and interlocking and securing with fasteners the second hub onto the first hub.

9 Claims, 3 Drawing Sheets

FIG-2
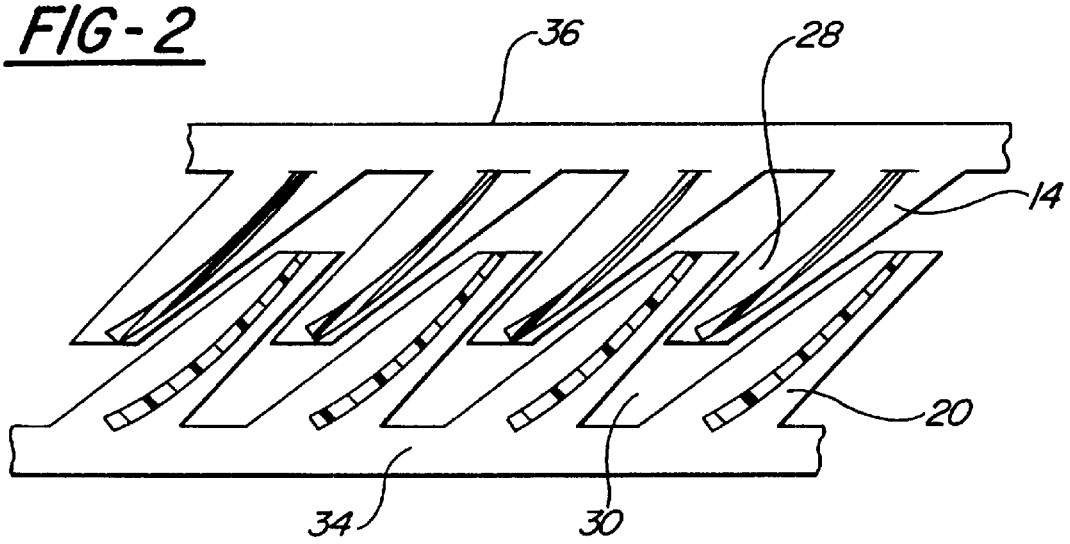
FIG-3
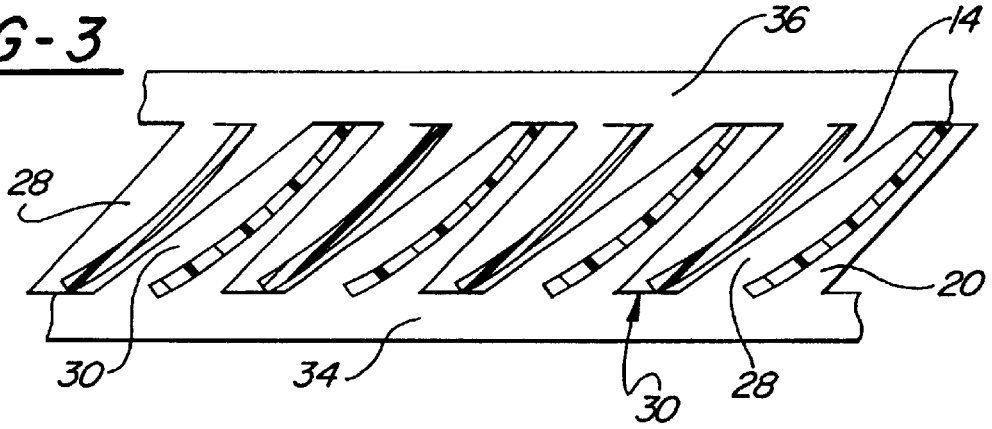
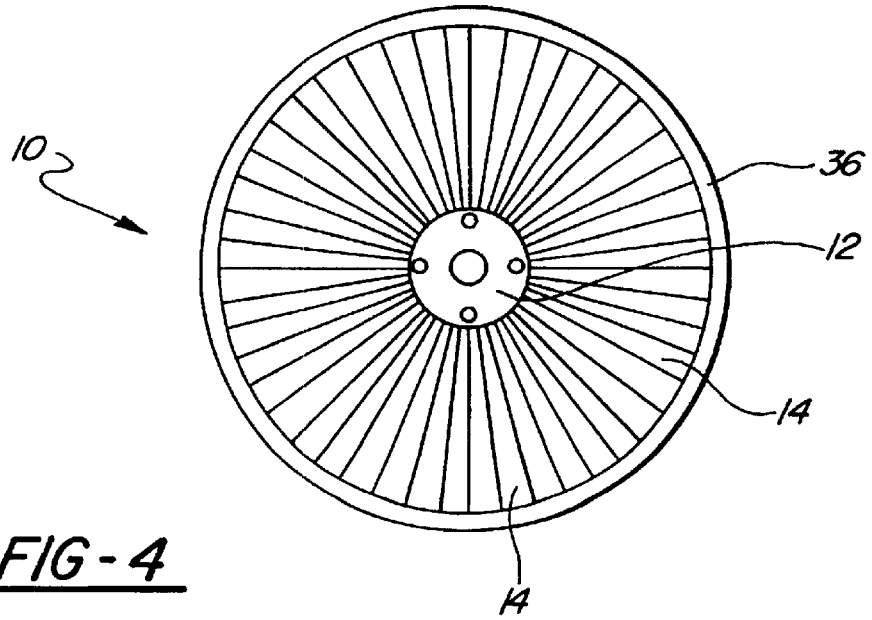
FIG-4

METHOD OF ASSEMBLING A HIGH SOLIDITY AXIAL FAN

BACKGROUND OF THE INVENTION

This application discloses a high solidity axial fan and a method of assembling the high solidity axial fan.

Typically, furnaces, air conditioners, air handlers and fan coil units utilize forward curved fans. Forward curved fans are much more costly to manufacture than a vane axial fan. Vane type axial fans have been used to replace the forward curved fans in many of these applications to take advantage of the cost savings. However, a vane axial fan is limited in applications due to poor stall characteristics. Stall is a phenomenon that occurs during specific flow conditions that causes partial flow reversal within the blade passage. Specifically, stall occurs when an angle between the fan blade and the incoming air flow is too steep causing a rise in static pressure across the fan blade typically when flow is reduced below the intended design point.

Increasing fan speed can offset the poor stall characteristics of axial fans. However, increasing fan speed results in a corresponding increase in noise. It is always desirable to have as little noise as possible for residential application such as furnaces and air conditioners.

A known method of preventing stall is to vary the angle and speed of the fan blades relative to air flow. Such systems are prohibitively expensive due to the control systems and mechanisms necessary to continually adjust the angle and speed of the fan blades and speed. Another method or preventing stall includes increasing the solidity of the fan. Solidity is the ratio of fan blade area to the swept area of the fan. Increasing fan solidity prevents stall by spreading the force differential between incoming air and outgoing air over a larger area, reducing the difference in pressure between the upper and lower surfaces of the fan blade to reduce tip leakage. High solidity also reduces the pressure gradient from the inlet of the fan blade to the trailing edge of the blade, and thus the possibility of flow separation. Further, a fan having high solidity can move the same amount of air with less blade pitch, which in turn prevents or improves stall characteristics. Improvements gained by increasing fan solidity are well known in the art.

A high solidity axial fan can be constructed by overlapping the fan blades, to increase the area of the fan blades relative to the swept area of the fan. However, manufacture of a high solidity fan is very difficult and cost prohibitive. Further, a fan constructed by plastic injection molding techniques would required a complex and prohibitively costly mold tool to mold overlapping fan blades.

For these reasons it is desirable to provide a method of constructing and assembling an axial vane fan having high solidity to improved stall properties such that the axial vane fan may be run at a reduced speed, thereby reducing noise, and making a vane type axial fan commercially feasible for use in residential applications.

SUMMARY OF THE INVENTION

The invention is a method of assembling a vane axial fan having high solidity to improve stall properties such that the vane axial fan may be run at reduced speeds, thereby reducing noise output.

The subject invention overcomes the problems of prior art vane axial fans by providing a two-piece axial fan assembly provides for the fan blades to be overlapped to increase solidity. The method of fabricating the vane axial fan of this invention includes, providing a first plurality of fan blades attached to a first hub, providing a second plurality of fan blades attached to a second hub, interfitting the second plurality of fan blades between the first plurality of fan blades and interlocking the second hub onto the first hub.

The method of assembling a vane axial fan provides a method of constructing and assembling an axial fan having high solidity to improved stall properties such that the axial fan may be run at a reduced speed, thereby reducing noise, and making a vane axial fan commercially feasible for use in applications requiring low noise emission.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows:

FIG. 2 is a cross-sectional view of the two hubs of the axial fan before being interfit;

FIG. 3 is a cross-sectional view of the two hubs and the fan blades completely interfit;

FIG. 4 is plane view of the completed axial fan assembly; and

DETAILED DESCRIPTION OF THE PREFERRED EMBODIMENT

Figure 1:
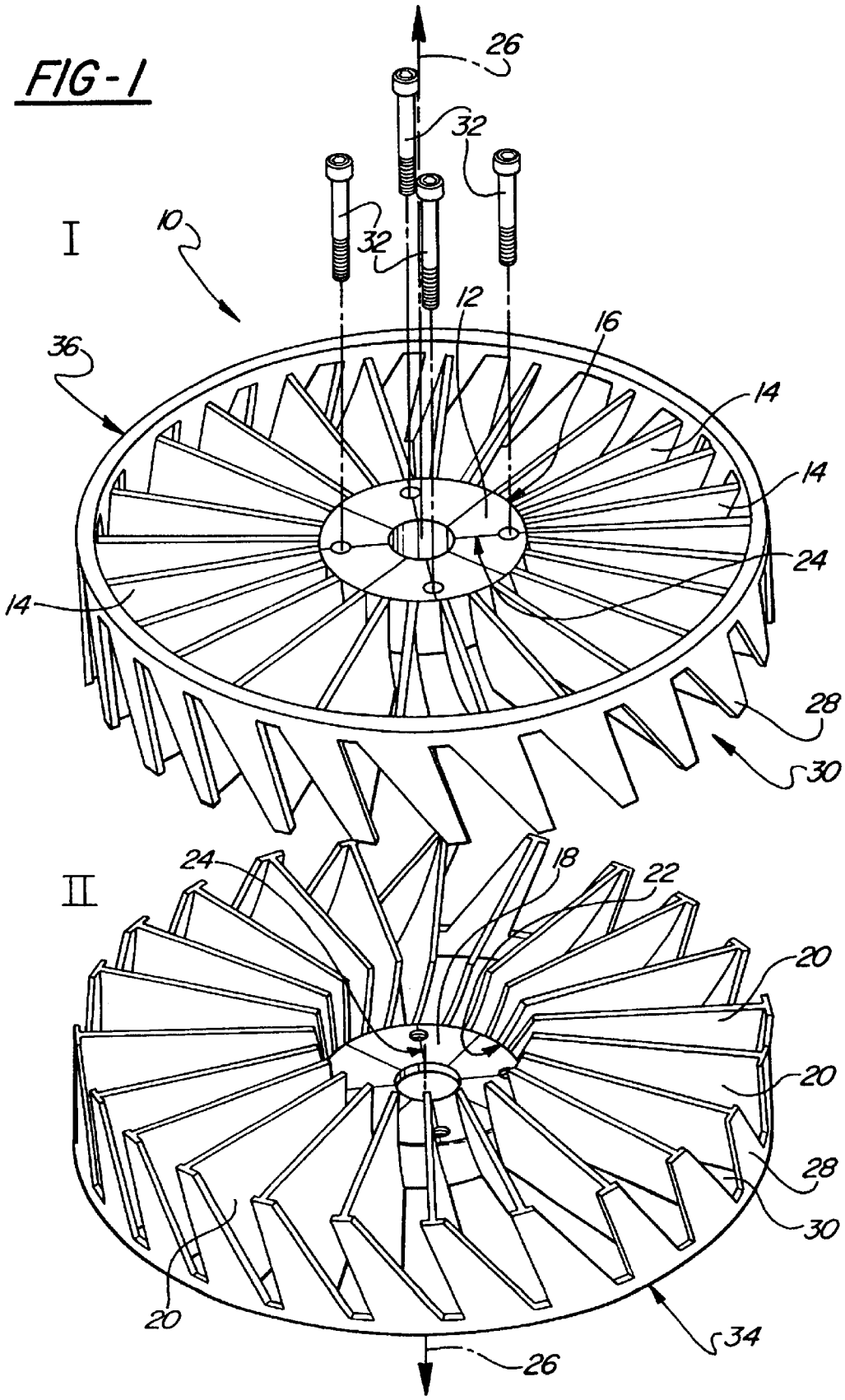
FIG. 1 is an exploded view of the two hubs of the axial fan.
Figure 5:
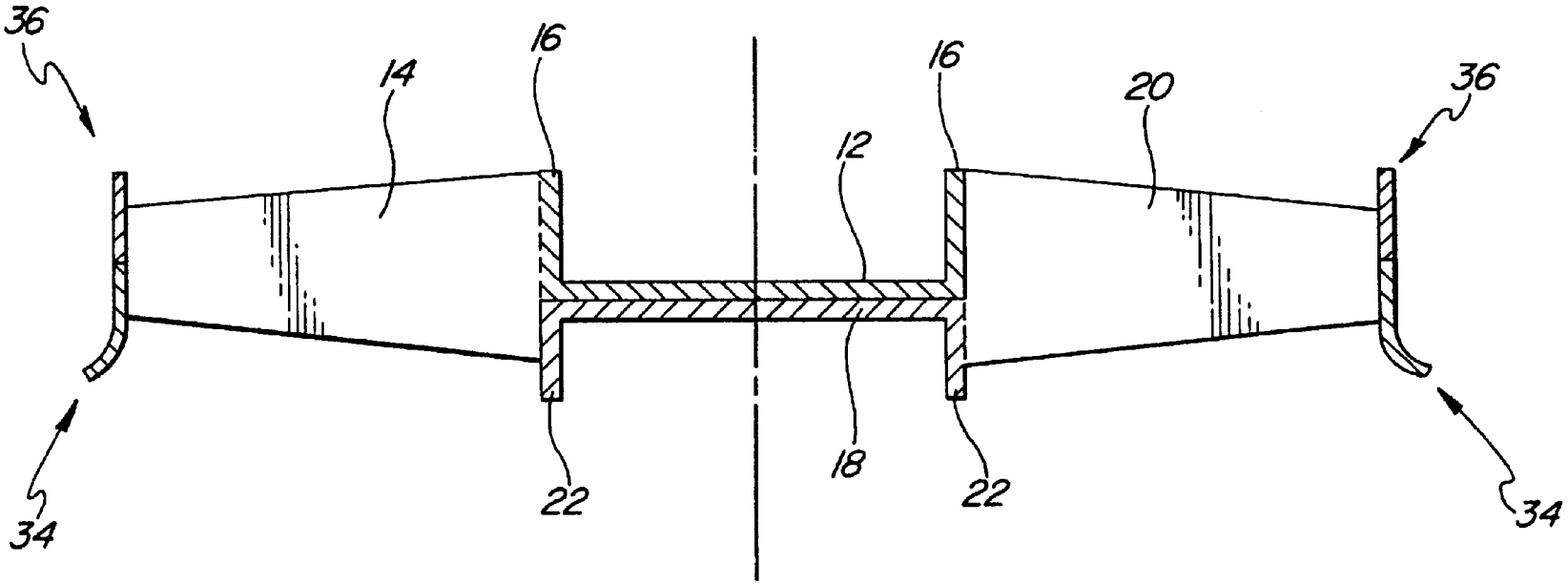
FIG. 5 is a cross-sectional view of the completed axial fan assembly.

The first and second hubs 12, 18 include a plurality of ribs 24 that extend from a inner peripheries 15,21 to the periphery 16,22 of each hub 12, 18. The inner periphery is concentric about a central axis 26. Surrounding each of the first and second plurality of fan blades 14, 20 are mating rings 34 and 36. The mating rings 34, 36 include a plurality of interlocking teeth 28 that matingly engage a slot 60 of the other mating ring. The mating rings 34, 36 align the first plurality of fan blades 14 with the second plurality of fan blades 20. The hub perimeter rings 16, 20 may be of a similar shape as the outer rings 34, 36 to also interlock. In the case of unshrouded fans there is no outer ring and the inner rings help align the blades and to interlock the two sections. It is within the contemplation of this invention that alignment of the fan blades 14,20 may be accomplished by any means known by a worker in the art. The first and second pluralities of fan blades 14, 20 are aligned such that there is overlap of the fan blades 14,20. As appreciated, overlapping the fan blades 14,20 provides for greater fan area to be positioned within the same swept area, resulting in an increase in solidity of the axial fan assembly 10. Again, increased solidity improves fan stall properties and improved stall properties allow the vane axial fan assembly 10 to be run at slower speeds without stalling. As appreciated, running the vane axial fan assembly 10 at slower speeds reduces noise, thereby making the vane axial fan 10 feasible for additional applications requiring low noise fan assemblies. The mating rings 34 and 36 constitute a rotating shroud to reduce tip noise. In some applications the fan may be constructed without a rotating shroud, free fan blade tips. In most cases the upper and lower sections I, II can be single molded pieces. Alternatively it may be composed of separate hubs 12, 18 to which are attached blades 14, 20 and shrouds 28.

Referring also to FIGS. 2 and 3, the method for assembling the high solidity vane axial fan assembly 10 includes the steps of providing a first plurality of fan blades 14 attached to a first hub 12, providing a second plurality of fan blades 20 attached to a second hub 18. Preferably the plurality of fan blades 14, 20 fabricated from plastic or aluminum and molded onto to each hub 12,18. Molding of the fan blades onto the hub would preferably include the steps of inserting the first hub 12 into a plastic injection mold (not shown) and molding the first plurality of fan blades 14 about the periphery 16 of the first hub 12. The second hub 18 is also inserted into the plastic injection mold and the second plurality of fan blades 20 are molded about the periphery 22 of the second hub 18. The mold may be configured to mold the fan blades onto both the first and second hubs at the same time, thereby creating the parts for a complete van axial fan assembly with each cycle of the mold.

The first plurality of fan blades 14 of the first hub 12 is then interfit into the and second pluralities of fan blades 20 of the second hub. As shown in FIG. 4, interfitting the pluralities of fan blades 14, 20 also overlaps the fan blades 14, 20, thereby providing for greater solidity. Specifically, overlapping of the fan blades is accomplished such that only one edge of each blade is visible when viewing the face of the vane axial fan assembly 10 as shown in FIG. 4. In other words, a perpendicular line extending from at least one edge of the fan blade will intersect one of the other fan blades. The first hub then interlocked to the second hub. Fasteners 32 (FIG. 1) secure the second hub 18 to the first hub 12. Preferably, the fasteners 32 are screws that extend through the first hub 12 and thread into the second hub 18. The resulting assembly includes a plurality of fan blades that overlap each other to provide the vane axial fan assembly 10 with high solidity. The fasteners may also be replaced with snap fits.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A method of fabricating a high solidity axial fan rotor, said method comprising the steps of;

providing a first plurality of fan blades attached to a first hub;

providing a second plurality of fan blades attached to a second hub, forming a tip of each fan blade into a single tooth;

interfitting said second plurality of fan blades between said first plurality of fan blades such that said first and second plurality of fan blades overlap one another; and interlocking the second hub onto the first hub.

2. The method of claim 1, further including the step of molding the first and second pluralities of fan blades onto the first and second hubs.

3. The method of claim 1, wherein said first and second hubs include rings about a perimeter of the fan blades.

4. The method of claim 3, wherein there are a plurality of said teeth on each of said rings.

5. The method of clam 1, further including the step of securing the first hub to the second hub with fasteners.

6. The method of claim 1, wherein in said step of interfitting said second plurality of fan blades between said first plurality of fan blades is further defined by twisting the fan blades of the first and second pluralities relative to one another.

7. The method of claim 1, further including the step of inserting the first hub into a plastic injection mold and molding the first plurality of fan blades about the periphery of the first hub.

8. The method of claim 1, further including the step of inserting the second hub into a plastic injection mold and molding the second plurality of fan blades about the periphery of the second hub.

9. The method of claim 1, further including the step of inserting the first and second hubs into a plastic injection mold and molding the first plurality of fan blades about the periphery of the first hub and molding the second plurality of fan blades about the second periphery.

* * * * *

UNITED STATES PATENT AND TRADEMARK OFFICE

CERTIFICATE OF CORRECTION

PATENT NO. : 6,508,628 B2
DATED : January 21, 2003
INVENTOR(S) : Amr

It is certified that error appears in the above-identified patent and that said Letters Patent is hereby corrected as shown below:

Title page,
The inventor's address should be changed, as follows: -- [75] Inventor: Yehia Mahmoud Amr, Cairo, Egypt --

Signed and Sealed this

Eighth Day of July, 2003

JAMES E. ROGAN
*Director of the United States Patent and Trademark Office*